US006672633B2

(12) United States Patent
Nomura et al.

(10) Patent No.: US 6,672,633 B2
(45) Date of Patent: Jan. 6, 2004

(54) VEHICLE DOOR HANDLE ASSEMBLY

(75) Inventors: Morihito Nomura, Chiryu (JP); Yasuo Imatomi, Toyota (JP); Kouichi Nagata, Obu (JP); Akira Kondo, Nagoya (JP); Atsushi Kamiya, Kariya (JP); Katsuaki Maruyama, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/207,776

(22) Filed: Jul. 31, 2002

(65) Prior Publication Data

US 2003/0038486 A1 Feb. 27, 2003

(30) Foreign Application Priority Data

Jul. 31, 2001 (JP) ..... 2001-232790

(51) Int. Cl.[7] ..... E05B 3/00

(52) U.S. Cl. ..... 292/336.3; 292/348; 292/DIG. 53; 292/DIG. 64

(58) Field of Search ..... 292/336.3, 347, 292/348, DIG. 53, DIG. 64, DIG. 63; 70/208, 210, 466

(56) References Cited

U.S. PATENT DOCUMENTS 4,475,754 A * 10/1984 Arlauskas et al. ..... 292/336.3
4,834,433 A * 5/1989 Keller ..... 292/336.3
4,924,582 A * 5/1990 Keller ..... 29/434
5,238,276 A * 8/1993 Burns ..... 292/347
5,282,657 A * 2/1994 Clinch et al. ..... 292/336.3
5,651,163 A * 7/1997 Tamaki ..... 292/336.3
5,685,581 A * 11/1997 Kritzler et al. ..... 292/336.3
5,706,554 A * 1/1998 Ruckert et al. ..... 292/336.3
6,059,329 A * 5/2000 Spitzley ..... 292/336.3
6,141,914 A * 11/2000 Feige et al. ..... 49/503
6,234,548 B1 * 5/2001 Mittelbach et al. ..... 292/336.3
6,439,626 B1 * 8/2002 Rohlfing ..... 292/347
6,454,325 B1 * 9/2002 Ramsey et al. ..... 292/347
6,543,090 B2 * 4/2003 Muneta ..... 16/412
6,550,295 B2 * 4/2003 Hubner ..... 70/208
6,565,134 B1 * 5/2003 Stuart et al. ..... 292/336.3
6,594,861 B2 * 7/2003 Dimig et al. ..... 16/412

FOREIGN PATENT DOCUMENTS

JP 8-35360 A 2/1996

* cited by examiner

*Primary Examiner*—J. J. Swann
*Assistant Examiner*—Thomas Ho
(74) *Attorney, Agent, or Firm*—Burns, Doane, Swecker & Mathis, LLP

(57) ABSTRACT

A handle lever is rotatable and movable in an axial direction relative to a frame and when the handle lever is rotatably moved from a predetermined position in a rotation direction with a predetermined amount against a urging force of a rotative urging spring and also moved from a predetermined position in the axial direction with a predetermined amount against a urging force of an axial urging spring, an engaging hook of the handle lever is engaged with an engaging portion of the frame in the rotation direction and the axial direction for holding the handle lever in a tentative holding position.

10 Claims, 6 Drawing Sheets

VEHICLE DOOR HANDLE ASSEMBLY

This application is based on and claims priority under 35 U.S.C. §119 with respect to Japanese Application No. 2001-232790 filed on Jul. 31, 2001, the entire content of which is incorporated herein by reference.

FIELD OF THE INVENTION

This invention generally relates to a vehicle door handle assembly. More particularly, the present invention pertains to a vehicle door handle assembly which includes a grip type outside door handle.

BACKGROUND OF THE INVENTION

A Japanese Patent Laid-Open Publication No. H08-35360 discloses a known vehicle door handle assembly of this kind. This known assembly includes a frame secured to an inside of an outer panel for a vehicle door and a handle lever rotatably assembled to the frame by a shaft portion and rotatably urged to a predetermined position in a rotation direction by a rotative urging spring. The vehicle door handle assembly further includes a grip type outer handle installed from an outside of the outer panel and rotatably operating the handle lever. At one end of the grip type outer handle, an engaging portion is provided for being engaged with a supporting portion in an inclinable manner provided at the frame by being inserted through an opening for insertion provided at the outer panel. At the other end of the grip type outer handle, an inserting projection having an engaging concave portion is provided for being engaged with an input portion of the handle lever by being inserted through each opening for insertion provided at the outer panel and the frame.

According to the vehicle door handle assembly disclosed in the above publication, the handle lever is assembled to the supporting portion provided at the frame by means of a supporting shaft so as to be rotatable and movable in an axial direction on the supporting shaft. In addition, a sliding guide lever rotatably assembled on the supporting shaft and rotatably urged to a predetermined position in the rotation direction by a spring (rotative urging spring) is engaged with the handle lever so as to be rotated as a unit. Then, the sliding guide lever is engaged with a stopper projection provided at the frame. The handle lever is urged in the axial direction by a second spring (axial urging spring) assembled on the supporting shaft and in contact with a stopper surface of the sliding guide lever for holding the handle lever in a tentative holding position. Under the condition that the handle lever is maintained at the tentative holding position, the handle lever is movable in the axial direction by overcoming the urging force of the second spring in the axial direction. By using this movement characteristic of the handle lever, the grip type outer handle can be installed in the frame by being pushed from the outside of the outer panel through one-touch operation.

According to the vehicle door handle assembly disclosed in the above publication, when the outer handle is installed in the frame by being pushed from the outside of the outer panel through one-touch operation, the handle lever is required to be moved in the axial direction against the urging force in the axial direction of the second spring. Thus, the assembly condition of the outer handle is not well.

SUMMARY OF THE INVENTION

It is an object of the present invention to improve an assembly condition of an outer handle toward a frame.

According to an aspect of the present invention, the vehicle door handle assembly includes a frame secured to an inside of an outer panel for a vehicle door, and a handle lever rotatably assembled to the frame by a shaft portion and rotatably urged to a predetermined position in a rotation direction by a rotative urging spring. The vehicle door handle assembly further includes a grip type outer handle installed from an outside of the outer panel and rotatably operating the handle lever. The grip type outer handle includes an engaging portion at one end being inserted through an opening for insertion provided at the outer panel and being engaged with a supporting portion in an inclinable manner provided at the frame, and an inserting projection having an engaging concave portion at the other end being inserted through each opening for insertion provided at the outer panel and the frame and being engaged with an input portion of the handle lever, and an engaging hook formed at the handle lever which is movable in an axial direction of the shaft portion relative to the frame. An engaging hook is formed at the handle lever which is movable in an axial direction of the shaft portion relative to the frame. An engaging portion is formed at the frame for being engaged and disengaged with the engaging hook. An axial urging spring is provided between the handle lever and the frame for urging the handle lever to a predetermined position in the axial direction in which the engaging hook is disengaged from the engaging portion in the axial direction. When the handle lever is rotatably moved from the predetermined position in the rotation direction with a predetermined amount against a urging force of the rotative urging spring and also axially moved from the predetermined position in the axial direction with a predetermined amount against a urging force of the axial urging spring, the engaging hook of the handle lever is engaged with the engaging portion of the frame in the rotation direction and the axial direction for holding the handle lever in a tentative holding position.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

An embodiment of the present invention will be explained referring to drawings.

Figure 1:
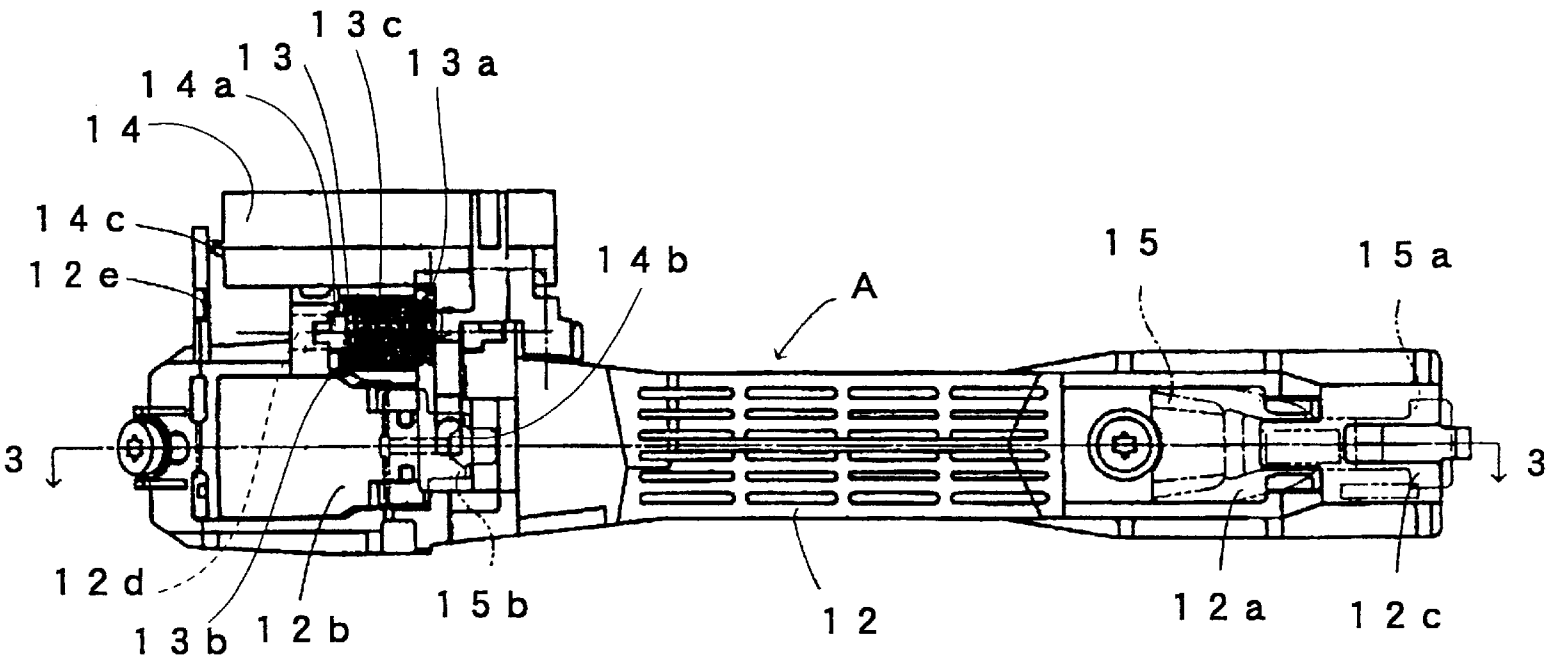
FIG. 1 is a side view of a vehicle door handle assembly viewed from an inside (vehicle compartment side) according to an embodiment of the present invention.
Figure 2:
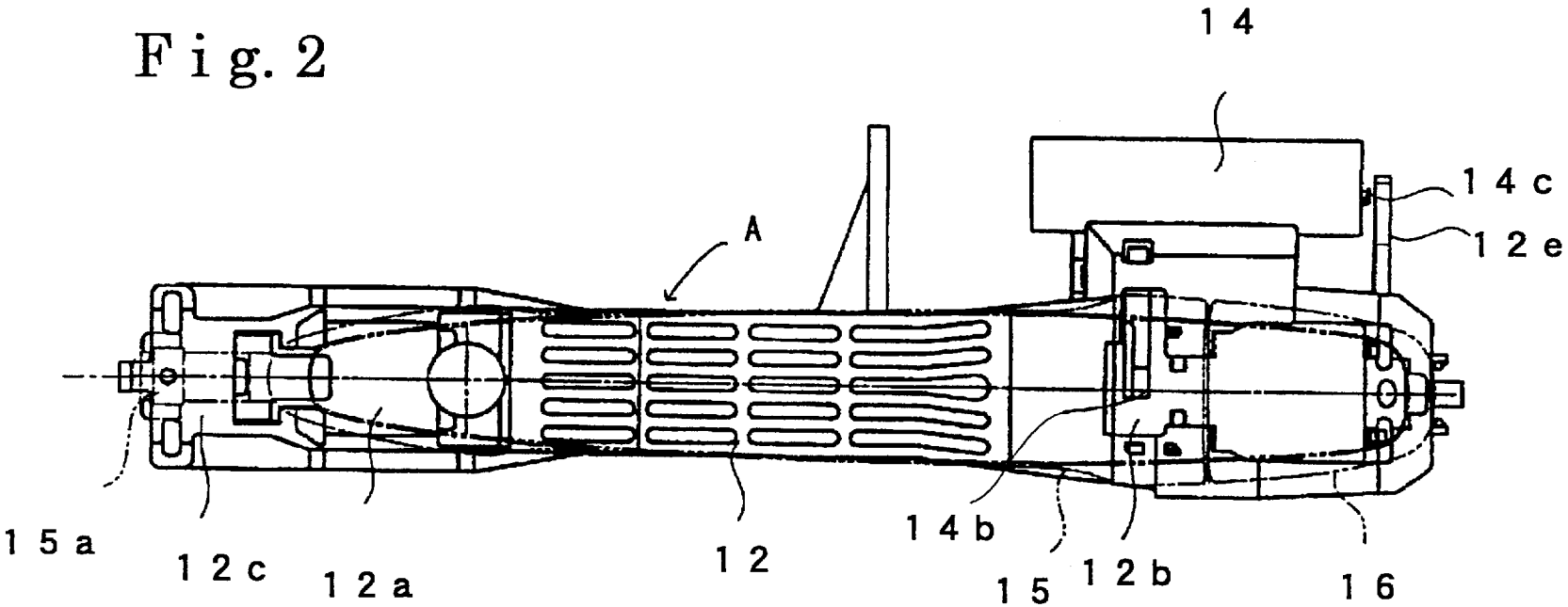
FIG. 2 is a side view of the vehicle door handle assembly of FIG. 1 viewed from an outside.

A vehicle door handle assembly A according to the present invention shown in FIGS. 1–6 includes a frame 12 secured to an inside of an outer panel 11 for a vehicle door, a handle lever 14 rotatably assembled to the frame 12 and rotatably urged to a predetermined position in a rotation direction shown in FIGS. 1,2 by a spring coil 13, and a grip type outer handle 15 installed from an outside of the outer panel 11.

The frame 12 includes an opening for insertion 12*a* through which an engaging portion 15*a* provided at one end of the outer handle 15 is inserted, and an opening for insertion 12*b* through which an inserting projection 15*b* provided at the other end of the outer handle 15 is inserted. The engaging portion 15*a* of the outer handle 15 is supported in an inclinable manner by a supporting portion 12*c* provided close to the opening for insertion 12*a*. In addition, the frame 12 includes a supporting hole 12*d* for supporting a shaft portion 14*a* of the handle lever 14 to be rotatable and movable in an axial direction as shown in FIG. 1. Further, the frame 12 includes an engaging portion 12*e* as a unit for holding the handle lever 14 in a tentative holding position as shown in FIG. 4. At the outer panel 11, openings for insertion 11*a*, 11*b* (shown in FIG. 3) are formed corresponding to the openings for insertion 12*a*, 12*b*.

The coil spring 13 has the feature as a rotative urging spring for urging the handle lever 14 in a clockwise direction as viewed from the right side of FIG. 1. The coil spring 13 also has the feature as an axial urging spring for urging the handle lever 14 rightward (axial direction) of FIG. 1. Under the condition that the coil spring 13 is assembled in a set position between the frame 12 and the handle lever 14 (condition in FIG. 1), a right end 13*a* of FIG. 1 is engaged with the handle lever 14. In addition, a left end 13*b* of FIG. 1 is engaged with the frame 12, and a cylindrical portion 13*c* is assembled to the shaft portion 14*a* of the handle lever 14 with a predetermined gap therebetween.

Figure 5:
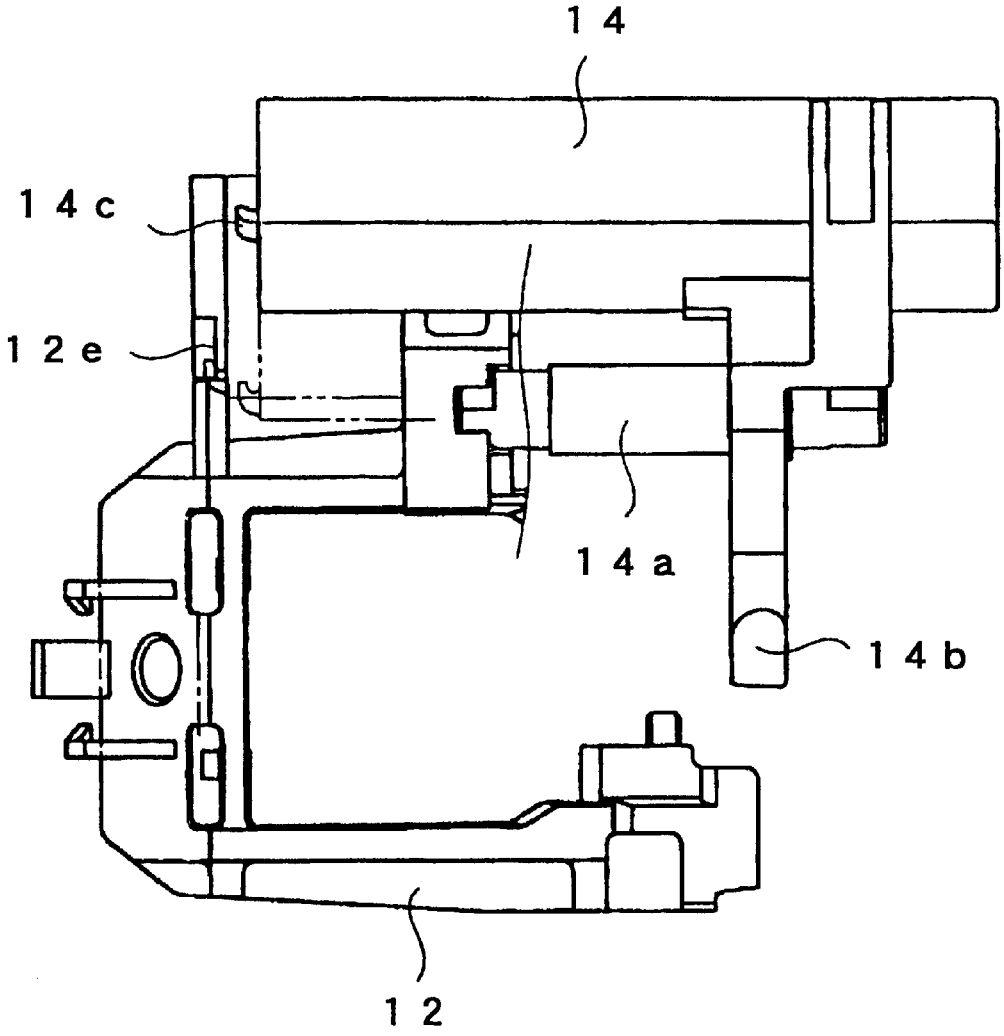
FIG. 5 is an enlarged side view of the vehicle door handle assembly showing a relationship between the frame and the handle lever of FIG. 4.
Figure 6:
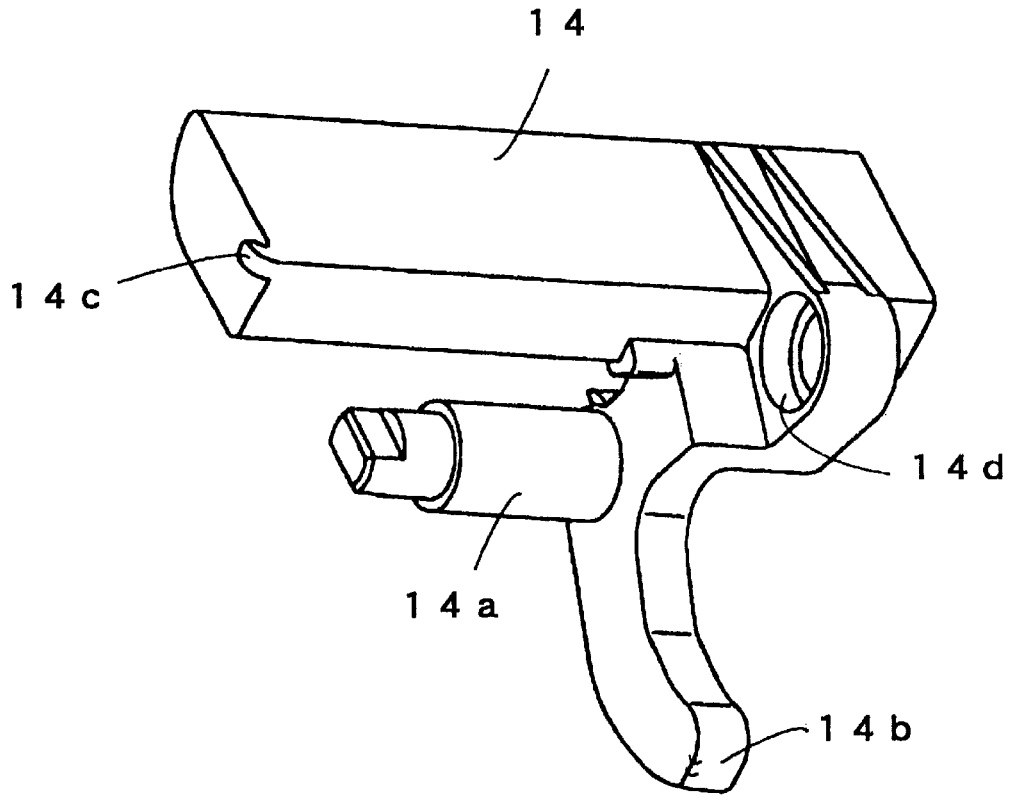
FIG. 6 is a perspective view of the handle lever of FIGS. 4,5.

The handle lever 14 is assembled to the frame 12 at both ends so as to be rotatable and movable in the axial direction. As shown in FIGS. 1, 5, 6, the shaft portion 14*a* is provided at a central portion of the handle lever 14 for holding the cylindrical portion 13*c* of the coil spring 13. Further, the handle lever 14 includes an input portion 14*b* being engaged with an engaging concave portion 15*b*1 formed at the inserting projection 15*b* of the outer handle 15, an engaging hook 14*c*, which is integrally formed with the handle lever 14, projecting in the axial direction and the rotation direction, and an installation hole 14*d* for installing a clip (not shown). The handle lever 14 may be also called as a bell crank.

The outer handle 15 is provided with the engaging portion 15*a* at one end for being engaged with the supporting portion 12*c* of the frame 12 in the inclinable manner. The outer handle 15 is also provided with the inserting projection 15*b* having the engaging concave portion 15*b*1 at the other end. The engaging concave portion 15*b*1 formed at the inserting projection 15*b* is engaged with the input portion 14*b* of the handle lever 14. By a cap 16 to be assembled to the frame 12 after the outer handle 15 is installed in the frame 12, the movement of the outer handle 15 along the outer panel 11 is restricted.

Figure 3:
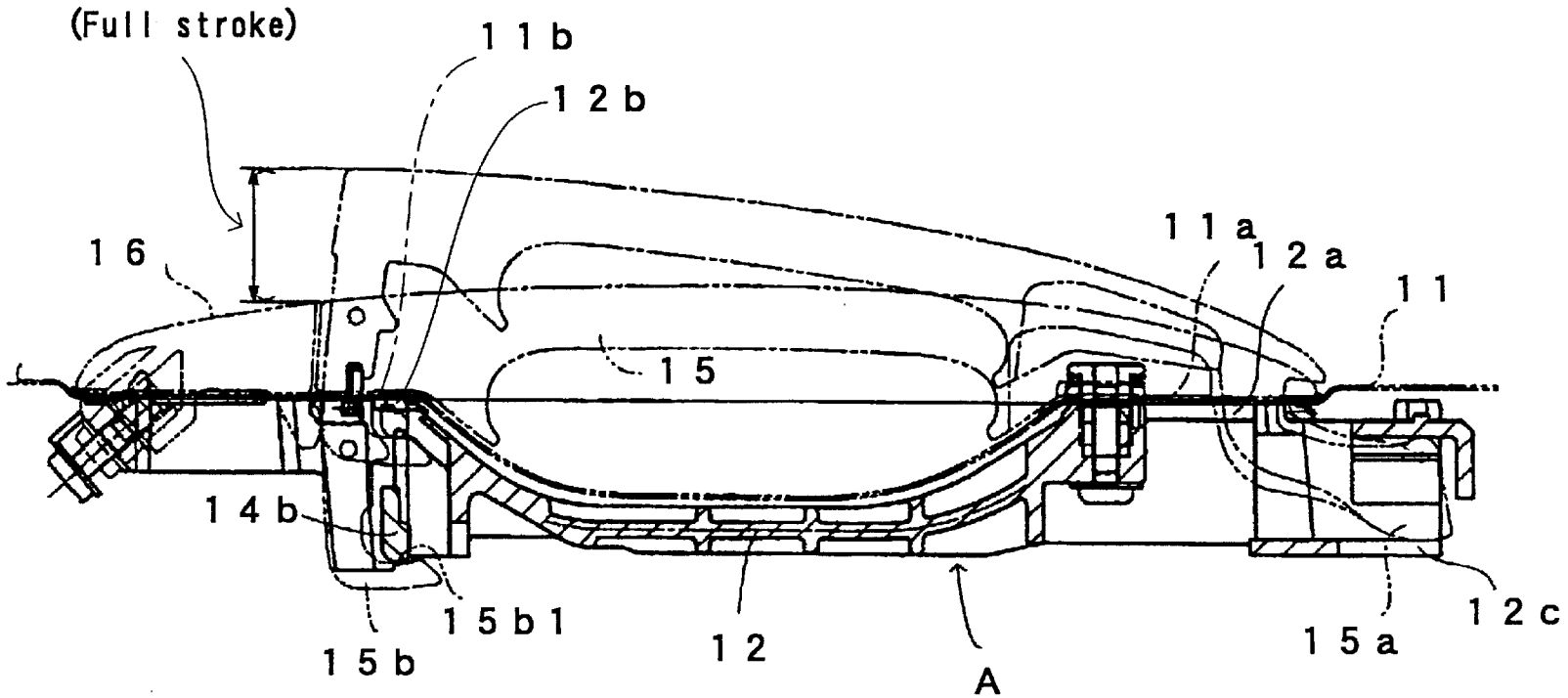
FIG. 3 is a cross-sectional view taken along a line 3—3 of FIG. 1.
Figure 4:
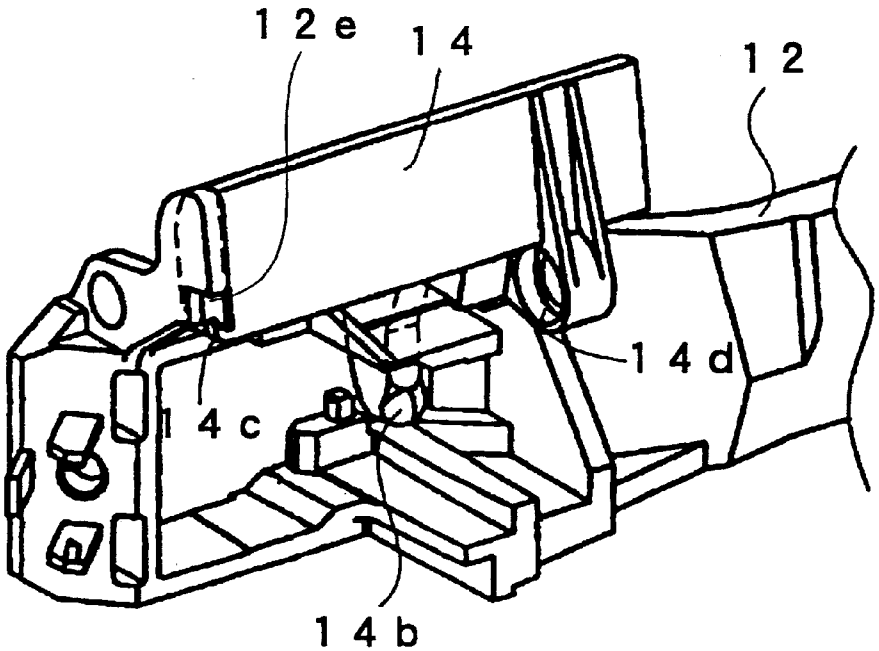
FIG. 4 is a perspective view of the vehicle door handle assembly under the condition that a handle lever is tentatively maintained in engagement with a frame of FIGS. 1–3.

When the outer handle 15 is moved with a full-stroke in an outward direction of the vehicle as shown in FIG. 3 under the condition that the outer handle 15 is assembled in a manner as shown by imaginary lines in FIGS. 1–3, the handle lever 14 is rotatably moved against the urging force of the coil spring 13. In case that the handle lever 14 is rotatably moved, a handle lever rod (not shown) connected to the installation hole 14*d* of the handle lever 14 via the clip is moved for releasing a lock of a door lock device (not shown).

According to the embodiment of the present intention configured in an aforementioned manner, when the handle levee 14 assembled to the frame 12 is rotatably moved from a predetermined position in the rotation direction (shown by a solid line in FIG. 5) to a position shown by the imaginary line in FIG. 5 with a predetermined amount against the urging force of the coil spring 13, and also axially moved from a predetermined position in the axial direction (shown by the solid line and the imaginary line in FIG. 5) to a position shown by a thin line in FIG. 5 with a predetermined amount against the urging force, of the coil spring 13 for engaging the engaging hook 14*c* of the handle lever 14 with the engaging portion 12*e* of the frame 12 in the rotation direction and the axial direction as shown in FIG. 4, the handle lever 14 can be maintained in the tentative holding position relative to the frame 12.

Accordingly, if the tentative holding position of the handle lever 14 is set in a specified position beforehand in which an access path of the inserting projection 15*b* is cleared for installing the outer handle 15 in the frame, and the engagement between the engaging hook 14*c* of the handle lever 14 and the engaging portion 12*e* of the frame 12 can be released in response to the outer handle 15 being moved with the full-stroke after the outer handle 15 is assembled to the frame 12 as shown by the imaginary line in FIG. 3 for engaging the inserting projection 15*b* of the outer handle 15 with the input portion 14*b* of the handle lever 14, the outer handle 15 can be installed in the frame 12 without interfering the handle lever 14 which is assembled to the frame 12 beforehand. Thus, an easy assembling can be available by inserting the outer handle 15 into the frame 12 and the assembly condition can be improved. The above-mentioned specified position is set at approximately 1–2 mm before the position in which the outer handle 15 is being moved with the full-stroke. In this specified position, the inserting projection 15*b* of the outer handle 15 is engaged and in contact with the input portion 14*b* of the handle lever 14 for rotating the handle lever 14 against the rotative urging force of the coil spring 13.

The vehicle door handle assembly of this embodiment can be feasible by providing the handle lever 14 which is rotatable and movable in the axial direction relative to the frame 12, the engaging hook 14*d* at the handle lever, the engaging portion 12*e* at the frame 12, and the axial urging spring between the handle lever 14 and the frame 12 for urging the handle lever 14 in the axial direction. Thus, the existing structure (frame 12 and handle lever 14) can be effectively used and the cost can be lower.

Especially in this embodiment of the present invention, the engaging hook 14*c* is integrally formed with the handle lever 14 and the engaging portion 12*e* is integrally formed with the frame 12. In addition, the rotative urging spring and the axial urging spring are configured by the single coil spring 13. Thus, the existing structure (frame 12, coil spring 13 and handle lever 14) can be effectively used and number of parts cannot be increased.

According to this embodiment of the present invention, the engaging hook 14*c* is integrally formed with the handle lever 14 and the engaging portion 12*e* is integrally formed with the frame 12. However, the engaging hook 14*c* and the engaging portion 12*e* can be separately formed with the handle lever 14 and the frame 12 respectively. In addition, the rotative urging spring and the axial urging spring are configured by the single coil spring 13. However, separate coil springs can be used.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A vehicle door handle assembly comprising:

a frame secured to an inside of an outer panel for a vehicle door;

a handle lever rotatably assembled to the frame by a shaft portion and rotatably urged to a predetermined position in a rotation direction by a rotative urging spring;

a grip type outer handle installed from an outside of the outer panel and rotatably operating the handle lever;

the grip type outer handle including an engaging portion at one end inserted through an opening for insertion provided at the outer panel and engaged with a supporting portion in an inclinable manner provided at the frame, and an inserting projection having an engaging concave portion at the other end being inserted through respective openings for insertion provided at the outer panel and the frame and being engaged with an input portion of the handle lever; whereby the handle lever is movable in an axial direction of the shaft portion relative to the frame;

an engaging hook formed at one of the handle lever and frame;

an engaging portion formed at the other of the frame and handle lever for being engaged and disengaged with the engaging hook; and an axial urging spring provided between the handle lever and the frame for urging the handle lever to a predetermined position in the axial direction in which the engaging hook is disengaged from the engaging portion in the axial direction;

wherein when the handle lever is rotatably moved from the predetermined position in the rotation direction with a predetermined amount against a urging force of the rotative urging spring and also axially moved from the predetermined position in the axial direction with a predetermined amount against a urging force of the axial urging spring, the engaging hook is engaged with the engaging portion in the rotation direction and the axial direction for holding the handle lever in a tentative holding position.

2. A vehicle door handle assembly according to claim 1, wherein:

the rotative urging spring and the axial urging spring are configured by a single coil spring.

3. A vehicle door handle assembly according to claim 1, wherein:

the engaging hook is integrally formed with the handle lever, and the engaging portion is integrally formed with the frame.

4. A vehicle door handle assembly according to claim 2, wherein:

the engaging hook is integrally formed with the handle lever, and the engaging portion is integrally formed with the frame.

5. A vehicle door handle assembly according to claim 2, wherein:

the coil spring is engaged with the handle lever at one end and engaged with the frame at the other end when provided at a set position between the handle lever and the frame.

6. A vehicle door handle assembly comprising:

a frame secured to an inside of an outer panel for a vehicle door;

a handle lever rotatably assembled to the frame and axially movable relative to the frame;

a rotative urging spring applying a rotative urging force to the handle lever;

a grip type outer handle installed from outside of the outer panel to rotatably operate the handle lever;

the grip type outer handle including an engaging portion at one end inserted through the outer panel and engaged with a supporting portion of the frame, and an inserting projection having an engaging concave portion at an opposite end inserted through the outer panel and into an insertion opening of the frame and engageable with an input portion of the handle lever;

an axial urging spring positioned to apply an axial urging force to the handle lever;

an engaging hook formed at one of the handle lever and frame;

an engaging portion formed at the other of the frame and handle lever;

the handle lever being rotatably movable and axially movable from a predetermined position against the rotative urging force and the axial urging force to cause the engaging hook and the engaging portion to engage one another and hold the handle lever in a tentative holding position; and the handle lever being axially movable by virtue of the axial urging force and rotatably movable by virtue of the rotative urging force when the grip type handle is operated so that the inserting projection applies a force to a portion of the handle lever sufficient to disengage the engaging hook and the engaging portion from one another.

7. A vehicle door handle assembly according to claim 6, wherein:

the engaging hook is provided at the handle lever and the engaging portion is provided at the frame.

8. A vehicle door handle assembly according to claim 6, wherein handle lever includes a shaft supported on the frame, the handle lever being rotatable about the shaft, the engaging hook being provided at a portion of the handle lever that is spaced from the shaft.

9. A vehicle door handle assembly according to claim 6, wherein:

the rotative urging spring and the axial urging spring are configured by a single coil spring.

10. A vehicle door handle assembly according to claim 9, wherein the coil spring has one end that engages the handle lever and an opposite end that engages the frame.

* * * * *